US007988250B2

(12) United States Patent
Hawkins et al.

(10) Patent No.: US 7,988,250 B2
(45) **Date of Patent: *Aug. 2, 2011**

(54) CONTINUOUS PRINTING USING TEMPERATURE LOWERING PULSES

(75) Inventors: Gilbert A. Hawkins, Mendon, NY (US); Siddhartha Ghosh, Rochester, NY (US); Christopher N. Delametter, Rochester, NY (US); Edward P. Furlani, Lancaster, PA (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/903,244

(22) Filed: Oct. 13, 2010

(65) Prior Publication Data

US 2011/0025741 A1 Feb. 3, 2011

Related U.S. Application Data

(63) Continuation of application No. 11/504,960, filed on Aug. 16, 2006, now Pat. No. 7,845,773.

(51) Int. Cl.

| | |
|---|---|
| ***B41J 29/38*** | (2006.01) |
| ***B41J 29/377*** | (2006.01) |
| ***B41J 2/165*** | (2006.01) |
| ***B41J 2/14*** | (2006.01) |
| ***B41J 2/05*** | (2006.01) |
| ***B41J 2/07*** | (2006.01) |
| ***B41J 2/02*** | (2006.01) |
| ***B41J 2/085*** | (2006.01) |

(52) U.S. Cl. ..... 347/11; 347/5; 347/18; 347/23; 347/49; 347/56; 347/57; 347/74; 347/75; 347/76

(58) Field of Classification Search ..... 347/5, 17, 347/20, 23, 26, 49, 56, 57, 73, 77, 11, 18, 347/74–76

See application file for complete search history.

(56) References Cited

U.S. PATENT DOCUMENTS

| | | | | |
|---|---|---|---|---|
| 1,941,001 | A | 12/1933 | Hansell | |
| 5,331,339 | A | 7/1994 | Takahashi | |
| 5,622,897 | A | 4/1997 | Hayes | 438/21 |

(Continued)

FOREIGN PATENT DOCUMENTS

| | | |
|---|---|---|
| WO | WO 03037632 | 5/2003 |

*Primary Examiner* — Charlie Peng
*Assistant Examiner* — Hung Lam
(74) *Attorney, Agent, or Firm* — William R. Zimmerli

(57) ABSTRACT

A printer includes a printhead and a source of liquid. The printhead includes a nozzle bore. The liquid is under pressure sufficient to eject a column of the liquid through the nozzle bore. The liquid has a temperature. A thermal modulator is associated with the nozzle bore. The thermal modulator is operable to transiently lower the temperature of the liquid as the liquid is ejected through the nozzle bore. An electrical pulse source is in electrical communication with the thermal modulator. The electrical pulse source is operable to provide a series of pulses to the thermal modulator that control the transient temperature lowering of the liquid. The series of pulses includes a first pulse applied at a first power level for transferring heat to the liquid, a second pulse applied at a second power level for transferring heat to the liquid, and a third pulse applied at a third power level for transferring heat to the liquid. The third power level is in between the first power level and the second power level.

9 Claims, 11 Drawing Sheets

U.S. PATENT DOCUMENTS

| | | | | |
|---|---|---|---|---|
| 5,623,292 | A | 4/1997 | Shrivastava et al. | |
| 5,920,331 | A * | 7/1999 | Silverbrook | 347/60 |
| 6,079,821 | A | 6/2000 | Chwalek et al. | |
| 6,450,619 | B1 | 9/2002 | Anagnostopoulos et al. | |
| 6,527,355 | B1 * | 3/2003 | Yang et al. | 347/14 |
| 6,575,566 | B1 | 6/2003 | Jeanmaire et al. | |
| 6,863,385 | B2 | 3/2005 | Jeanmarie et al. | |
| 2001/0043244 | A1 | 11/2001 | Sakuma | |
| 2003/0128267 | A1 * | 7/2003 | Teung et al. | 347/112 |
| 2003/0202053 | A1 | 10/2003 | Hawkins et al. | 344/77 |

* cited by examiner

CONTINUOUS PRINTING USING TEMPERATURE LOWERING PULSES

CROSS REFERENCE TO RELATED APPLICATIONS

This is a continuation application of U.S. application Ser. No. 11/504,960 filed Aug. 16, 2006 now U.S. Pat. No. 7,845,773.

FIELD OF THE INVENTION

The present invention relates generally to the field of digitally controlled printing devices, and in particular to continuous ink jet print heads that integrate multiple nozzles on a single substrate, and create droplets through thermal modulation applied to the fluid column ejected from each nozzle.

BACKGROUND OF THE INVENTION

Ink jet printing has been currently identified as one of the most successful candidates for the technology of choice in the digitally controlled, electronic printing market. Two prominent forms of this technology are drop-on-demand (DOD) and continuous ink jet (CU). CIJ technology was identified as early as 1929, in U.S. Pat. No. 1,941,001 issued to Hansell. In the 1960s, CIJ printing mechanisms were developed that made use of acoustically driven print heads to break off ink droplets that would be appropriately deflected by electrostatics. Since this time, there have been numerous advances in the implementation of CU printers, including the use of CMOS/MEMS integrated print heads with resistive heating elements to break up a fluid column into drops. The drops created by heat pulses may be positioned through the use of techniques such as air deflection. These concepts have been disclosed in U.S. Pat. Nos. 6,079,821, 6,450,619, 6,863,385.

Using heat to break up the drops allows a greater degree of freedom in controlling individual streams of fluid, as opposed to the use of acoustic control to break up drops uniformly at all nozzles of the print head. Furthermore, the use of air deflection in place of electrostatics reduces the requirements placed on ink properties, for example conductivity requirements. By adjusting the electrical potentials applied to the resistive heater with respect to time, one can control the size of the drops that are produced. Heat may be applied to the fluid, via an adequate electrical potential supplied to the print head heaters, frequently to create small drops. Less frequent application of heat pulses generates larger drops, as described in U.S. Pat. No. 6,575,566. Therefore, specific electrical waveforms may be created to apply to the heaters of the print head as necessary.

The application of the heat pulses, however, has undesired effects under certain conditions. These effects are evident when dealing with larger sized drops, for example, a drop formed by two heat pulses widely spaced in time. Fluid instabilities appear within regions of the large drop that are meant to be contiguous and cause the drop to break up, as can be appreciated by an expert in fluid dynamics. The break-up of large drops is generally deleterious to high quality printing, since the drop volumes are not well controlled and thus the drops may not be used as intended. When the large drops break up into smaller pieces, they generally travel an additional distance in space before they re-form by joining, as is also known in the art of fluid dynamics. The total distance the stream must travel from the printhead surface in order to form controlled drops that can be used as intended in printing is termed the "coalescence length." Generally, it is desired that the coalescence length be minimized. For example, in the printing methods using air deflection to position drops (U.S. Pat. Nos. 6,079,821, 6,450,619, 6,863,385) the accuracy of positioning degrades if the large drops break up into smaller drops, or if the coalescence length is too long. This is because drops deflect differently in the air depending on their size, as can be appreciated by one knowledgeable in classical mechanics; and because a long coalescence length requires the receiver to be remote from the printhead, further degrading drop placement accuracy, as is well known in the art of inkjet printing. Clearly there is a need in the industry of inkjet printing to provide well-controlled drops and to minimize the distance of the receiver to the printhead.

SUMMARY OF THE INVENTION

One object of the present invention to provide a way to create large drops for use in CIJ printing that are well controlled and have minimal coalescence lengths. Thereby, the print head may be placed closer to the print media, and a greater degree of control over the size and shape of the drops that are produced may be achieved.

In accordance with the present invention, the unintended break-up of large drops is reduced or even prevented by selectively lowering the temperature of the stream of jetting fluid. It has been observed that the coalescence length of large drops may be reduced when the heat is removed (or the temperature is lowered or a "cold pulse" is applied) closely after the application of a regularly intended heat pulse. Cooling effects may be generated through the use of thermoelectric generators, endothermic chemical reactions, mechanical thermal cantilevers, gas compression pumps and other means.

According to one aspect of the present invention, a printer includes a printhead and a source of liquid. The printhead includes a nozzle bore. Liquid from the source of liquid is provided under pressure sufficient to eject a column of the liquid through the nozzle bore. The liquid has a temperature. A thermal modulator is associated with the nozzle bore. The thermal modulator is operable to transiently modulate the temperature of the liquid as the liquid is ejected through the nozzle bore to cause drops to break off from the column of liquid ejected from the nozzle. An electrical pulse source is in electrical communication with the thermal modulator. The electrical pulse source is operable to provide a series of pulses to the thermal modulator that control the transient temperature lowering of the liquid. The series of pulses includes a first pulse applied at a first power level for transferring heat to the liquid, a second pulse applied at a second power level for transferring heat to the liquid, and a third pulse applied at a third power level for transferring heat to the liquid. The third power level is in between the first power level and the second power level.

The application of the first pulse can cause a drop to break off from the column of liquid.

According to another aspect of the present invention, a method of forming liquid drops includes providing a printhead including a nozzle bore; providing a source of liquid under pressure sufficient to eject a column of the liquid through the nozzle bore, the liquid having a temperature; providing a thermal modulator associated with the nozzle bore, the thermal modulator being operable to transiently modulate the temperature of the liquid as the liquid is ejected through the nozzle bore to cause drops to break off from the column of liquid ejected from the nozzle; providing an electrical pulse source in electrical communication with the thermal modulator; and causing a series of pulses to be provided to the thermal modulator that control the transient temperature lowering of the liquid using the electrical pulse source, the series of pulses including a first pulse applied at a first power level for transferring heat to the liquid, a second pulse applied at a second power level for transferring heat to the liquid, and a third pulse applied at a third power level for transferring heat to the liquid, the third power level being in between the first power level and the second power level.

BRIEF DESCRIPTION OF THE DRAWINGS

In the detailed description of the example embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1A:
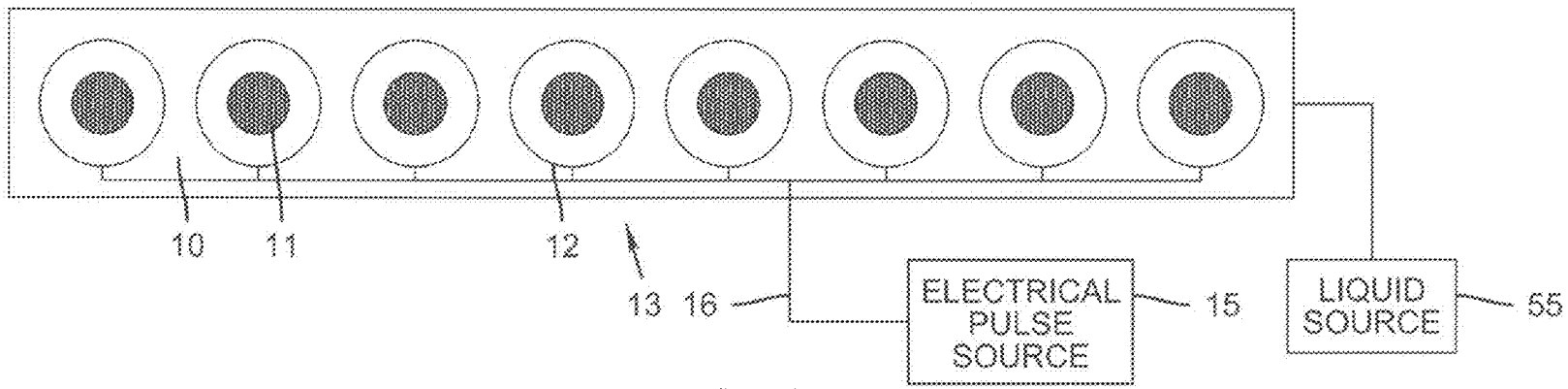
FIG. 1A is a schematic top view of a print head including a nozzle bore array.

Referring to FIG. 1A there is shown a top view of a print head 10 of a continuous type printer. Printhead 10 includes a nozzle bore 11, typically arranged in an array. The array can be linear or two dimensional and its density can be at least 600 nozzles per inch. A source of liquid 55 provides liquid under pressure sufficient to eject a column of the liquid through the nozzle bore 11. The liquid has a temperature. Surrounding each bore on the print head is the resistive heater 12, which is controlled by CMOS circuitry to break up the ink stream as required for printing. The heater 12 may take the shape of one or more portions of a ring surrounding the nozzle bore 11.

A thermal modulator 13 is associated with the nozzle bore 11. The thermal modulator 13 is operable to transiently lower the temperature of the liquid as the liquid is ejected through the nozzle bore 11. Thermal modulator 13 including, for example, heater 12 may be supplied with electric potential from an electrical pulse source 15. The pulse source 15 is connected to each thermal modulator 13 via the electrical pulse connector 16. The thermal modulator 13 is capable of both raising the temperature of the liquid jet and lowering the temperature of the liquid jet. Lowering the temperature of the liquid jet can also be referred to as removing heat from the liquid. In this sense, these terms as used herein are interchangeable.

Figure 1B:
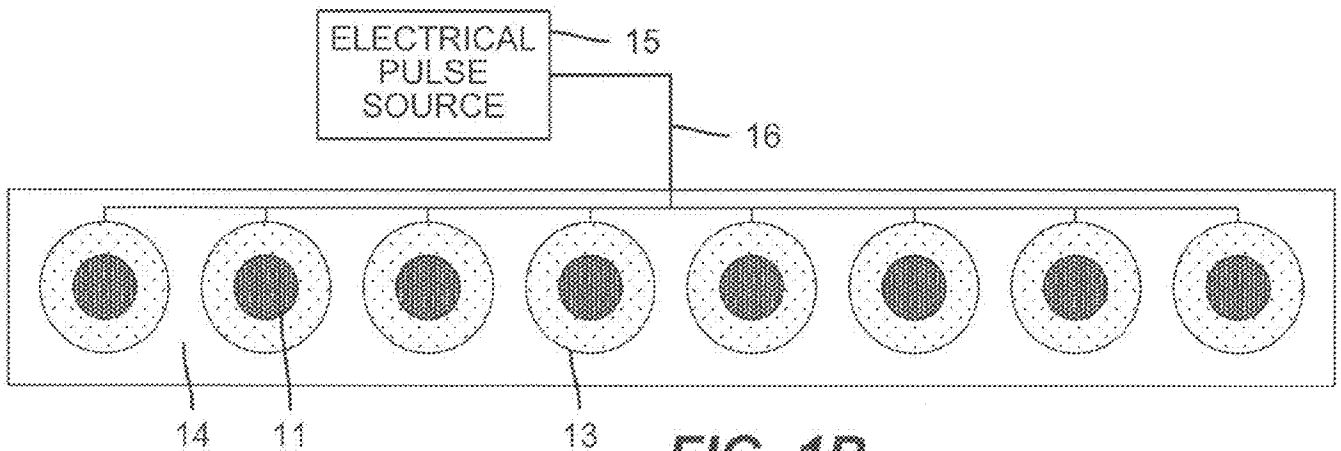
FIG. 1B is a schematic top view of a print head constructed in accordance with the present invention connected to the electric pulse generator.

FIG. 1B shows a top view of the print head 10 in accordance with the present invention. Each nozzle bore 11 of the printhead 10 shown in FIG. 1B is surrounded by a thermal modulator 13. Each thermal modulator 13 is supplied with electric potential from the electrical pulse source 15. The pulse source 15 is connected to each thermal modulator 13 via the electrical pulse connector 16. Pulse source 15 and connector 16 may also be used to supply energy to the resistive heater 12 of the printhead 10 shown in FIG. 1A in a similar fashion. The thermal modulator is capable of raising and lowering the temperature of the liquid. Several examples of this thermal modulator are provided in FIG. 2-5. Each figure depicts the thermal modulator 13 as exactly one half of a ring surrounding the nozzle bore, although it is not limited to this shape.

As will be discussed, applying heat to the jet has the effect of reducing the fluid viscosity and causing the stream to break up due to the Marangoni effect. Removing heat from the stream is believed to have the opposite effect, and causes the stream diameter to increase. The following descriptions are of thermal modulators that are capable of removing heat from the stream very soon after the application of a heat pulse, in order to reduce the coalescence length of the resultant drops.

Figure 2A:
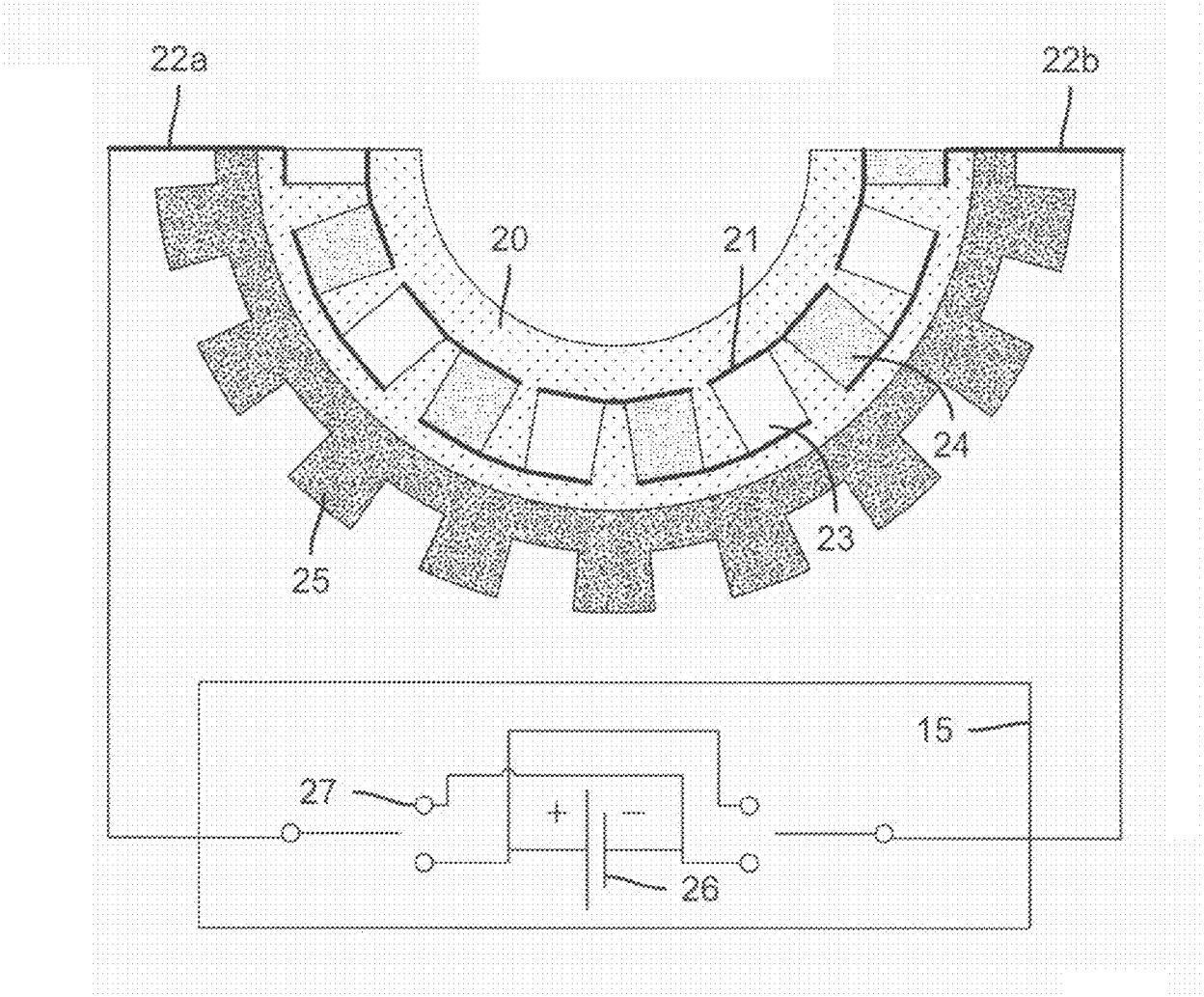
FIG. 2A is a top view of the thermal modulator from FIG. 1B configured as a thermoelectric device.

FIG. 2A shows an example embodiment of the thermal modulator configured as a thermoelectric device. Thermal conductor 20 is the object that is directly in contact with the liquid stream. It is formed of a highly heat conductive material, such as polysilicon or a metal, which can be the same material as that of the resistive heater 12. In contact with the conductor 20, are n- and p-doped pellets 23 and 24 respectively, which are inherently responsible for heating and cooling, depending the direction of current flow. The material doped to form the pellets may be, but is not restricted to, bismuth and telluride. N-doped pellets 23 and p-doped pellets 24 are joined together by the copper trace 21, which provides the path for electricity, and allows the pellets to be connected in series. Therefore, electrons in the n-doped pellets and holes in the p-doped pellets may transport heat in the same direction (away from or towards the liquid stream running through bore 11). In the cooling operation, heat sink 25 provides the object into which the heat drawn out of the liquid stream may be dissipated. The pellets, connected via copper trace 21, are connected to a power supply through the electrode 22 (a as well as b) on either side of the thermal modulator. Finally, each electrode 22 is connected to the DC power supply 26, through a polarity determining switch 27. A switch appears on either side of the power supply as shown in FIG. 2A. If both switches are turned down as shown in the figure, the positive terminal of the power supply 26 will be in contact with the n-doped pellet 23, and the p-doped pellet 24 will be in contact with the negative terminal of the power supply 26. As a result, the inner portion of conductor 20 will be cooled, as electrons and holes will flow towards the heat sink 25. Likewise throwing both of the switches up will cause the polarity of the power supply 26 to be reversed and the opposite process will occur; that is, the inner portion of conductor 20 will be heated as is well known in the art of peltier cooling devices. Heat will flow into the liquid stream from the side of the heat sink, and the thermal modulator will have the same effect as the heater 12 alone. DC supply 26 and polarity determining switches 27 are also drawn within a box representing the electrical pulse source 15, because the operation mechanism involving the switches may be replaced with the internal workings of the pulse source 15, which can produce electrical waveforms as appropriate. Therefore, the thermal modulator described in FIG. 2A is controlled completely with electricity, and can provide either heat or cold "pulses" to the jet stream. Since a thermoelectric device is a heat pump, excess heat or cold is conducted away by heat sink 25 and is not felt by the jet stream.

Figure 2B:
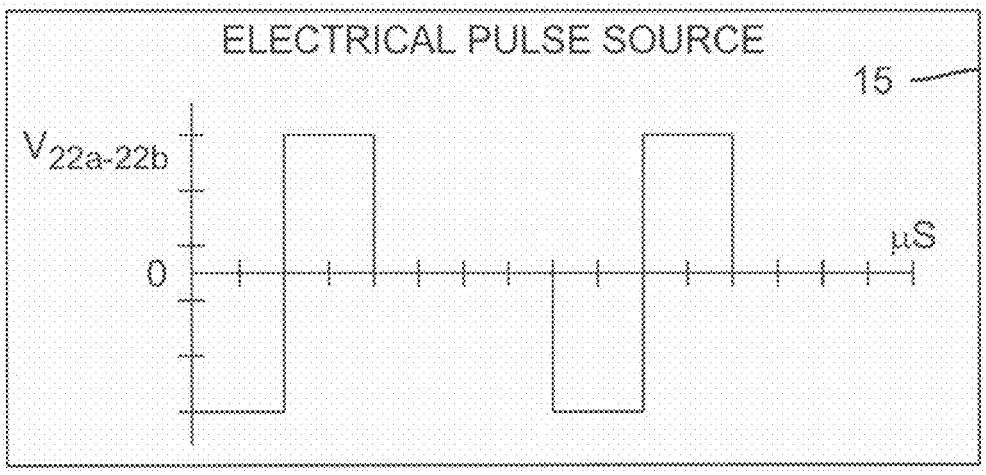
FIG. 2B is a control diagram for the thermoelectric device, showing a graph of the electrical waveform applied to the device electrodes.

FIG. 2B provides a voltage waveform to operate the thermal modulator of FIG. 2A to produce both hot and cold pulses as intended. This is the waveform output from electrical pulse generator 15 to activate thermal modulator 13. The voltage referenced on the waveform graph, $V_{22a\text{-}22b}$, describes the voltage applied to electrode 22*a* with respect to electrode 22*b* versus the independent variable of time (measured in microseconds). This waveform describes the same method outlined in the section above using polarity determining switches 27. That is, when $V_{22a\text{-}22b}$ is negative, it corresponds to switches 27 being both up, and heat being applied to the jet. Likewise having $V_{22a\text{-}22b}$ be negative corresponds to the switches being down, and cooling occurring. Therefore, the combination of the DC power supply 26 and polarity determining switches 27 may be replaced by the combination of the electrical pulse source 15 and connector 16 supplied with the waveform shown in FIG. 2B.

Figure 2C:
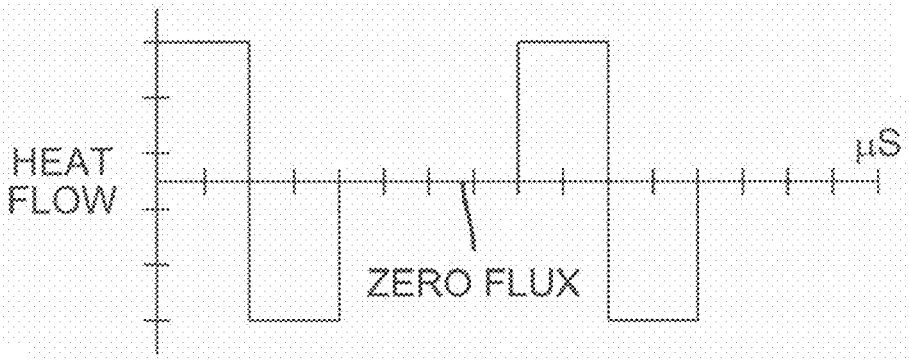
FIG. 2C is a graph of the heat flow through the thermoelectric device corresponding to the electrical pulses of FIG. 2B.
Figure 2D:
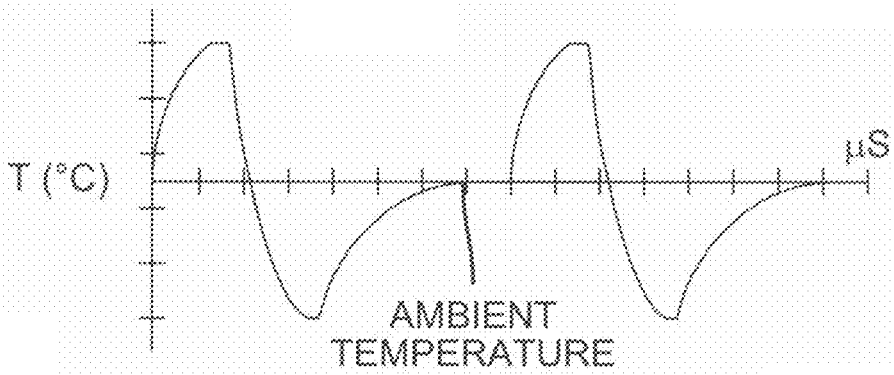
FIG. 2D is a graph of the temperature of the jet coming out of the print head as a result of the heat flow in FIG. 2C.
Figure 2E:
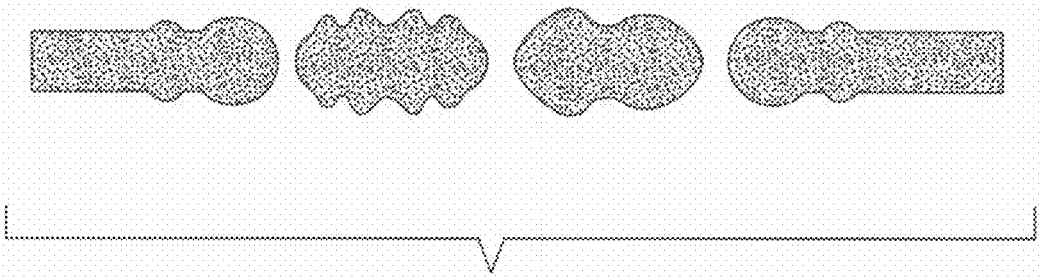
FIG. 2E is a representation of the jet breakup with and without a stabilizing cold pulse applied to it.

FIG. 2C is a graph of the heat flow through the thermal modulator 13 corresponding to the voltage applied to it in FIG. 2B. In FIG. 2B, the first 2 microseconds of heat pulse is followed by 2 microseconds of cold pulse in every period of the waveform. During the heat pulse, heat flows into the jet from thermal modulator 13, and during the cold pulse, heat flows out (negative flux). Therefore, the flux through the thermal modulator is shown correspondingly. In FIG. 2D the temperature of the outside surface of the jet exiting the nozzle bore 11 is shown in relation to the heat flux graph given in FIG. 2C. The graph centers around the ambient temperature of the fluid. During the heat pulse, the jet temperature is raised at least 2 degrees Celsius above the ambient temperature. Likewise, the cold pulse lowers the jet temperature at least 2 degrees Celsius below the ambient temperature. FIG. 2E shows a representation of the jet stream to demonstrate the effect of the cold pulse. The figure depicts two large drops or "slugs" of fluid, one to the right of the other, that have been broken off from the center of a fluid jet in response to a series of three heat pulses, each having caused jet pinch off at the right side of the right slug, between the slugs, and at the left side of the left slug respectively, as disclosed in U.S. Pat. Nos. 6,079,821, 6,450,619, 6,863,385. The right slug has, in addition to heat pulses applied to break it off from the fluid jet, a cold pulses applied in accordance with the waveform pulses below the horizontal axis of FIG. 2*b*. The left slug has received only heat pulses applied to break it off from the fluid jet, that is, only the pulses show above the horizontal axis of FIG. 2*b*. We see in FIG. 2E that the drop on the left has a number of pronounced variations in radius along its length. These variations or "surface profile instabilities" are well known to exacerbate breakup of end portions of the slug to form broken off portions and to increase the coalescence length for the broken off portions to remerge with the main drop. The drop on the right in contrast shows a reduction of surface profile instabilities as a result of the cold pulse application and the coalescence length for the right drop is found to be more than 25% shorter than that for the left drop.

Figure 3A:
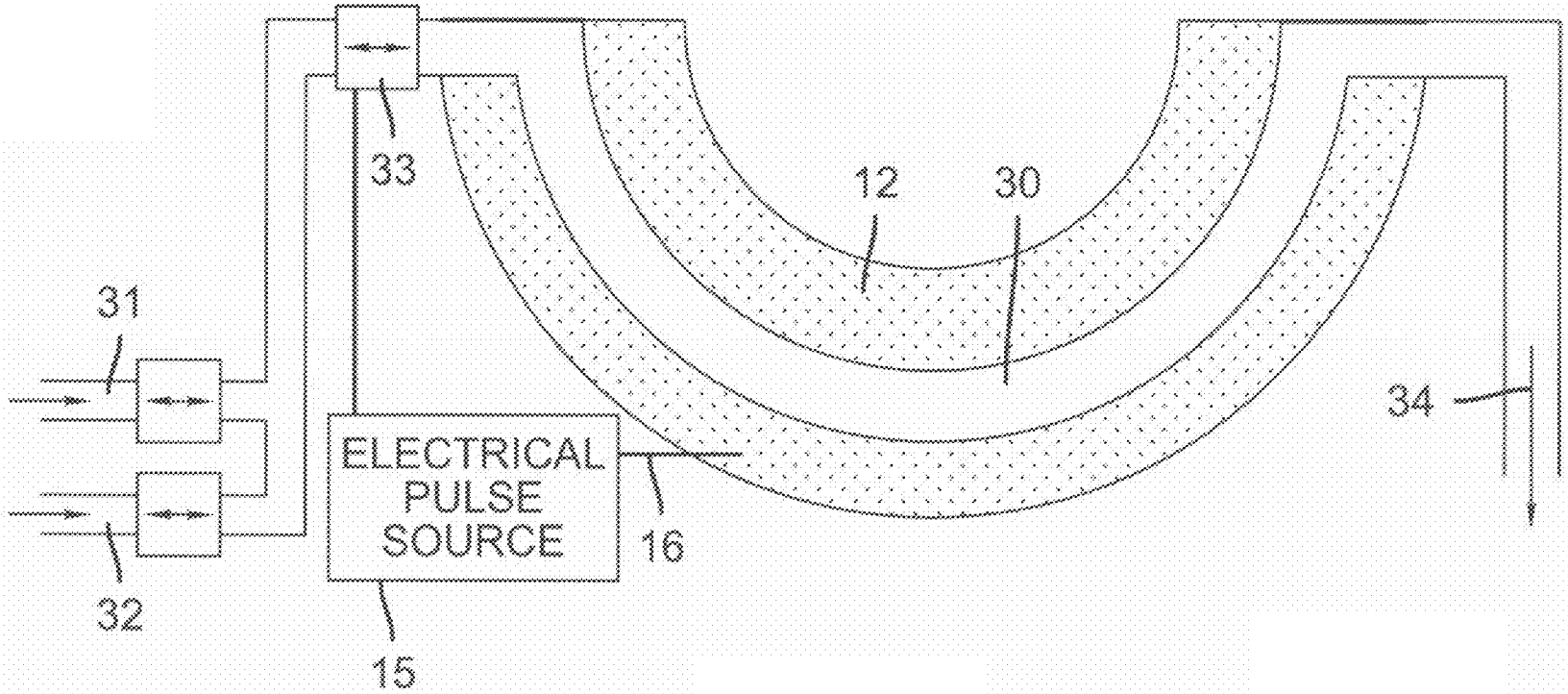
FIG. 3A is a top view of a thermal modulator from FIG. 1B that makes use of an endothermic chemical reaction.

In FIG. 3A, there is shown a second embodiment of a thermal modulator that can make use of the products from an endothermic chemical reaction in order to cool the stream of fluid exiting nozzle bore 11. This thermal modulator makes use of a resistive heater 12, which is also a good thermal conductor for example polysilicon or a thin metallic film. However running through the center of the heater is a cold fluid channel 30. When a very cold fluid is sent through channel 30, heat is removed from the jet exiting nozzle bore 11 through the thermally conducting material of resistive heater 12. The cold fluid may be produced through an endothermic chemical reaction that results from the mixture of chemical 1 which comes through inlet 31, and chemical 2 which comes through inlet 32. Alternately, an inherently cold fluid such as, but not limited to liquid nitrogen, may be sent through inlet 31, while inlet 32 is not used at all. After the cold fluid is ready for entering the channel 30 and performing its heat removing function, it may be released into the channel through the valve 33. Any fluid in the channel 30 is constantly drawn out by suction through the outlet 34. Therefore, controlling the release of fluid through the channel 30 by the means of valve 33 allows cold pulses of varying duration to be applied. As implied earlier, when a hot pulse needs to be delivered to the jet, the cold pulse function will be deactivated by valve 33, and electrical stimulation will be applied to resistive heater 12. Alternatively, the cold fluid may be left running at all times and the electrical stimulation of heater 12 may be adjusted in time so as to either raise or lower the temperature of the surface of the fluid jet by compensating the cooling effects of the cold fluid.

Figure 3B:
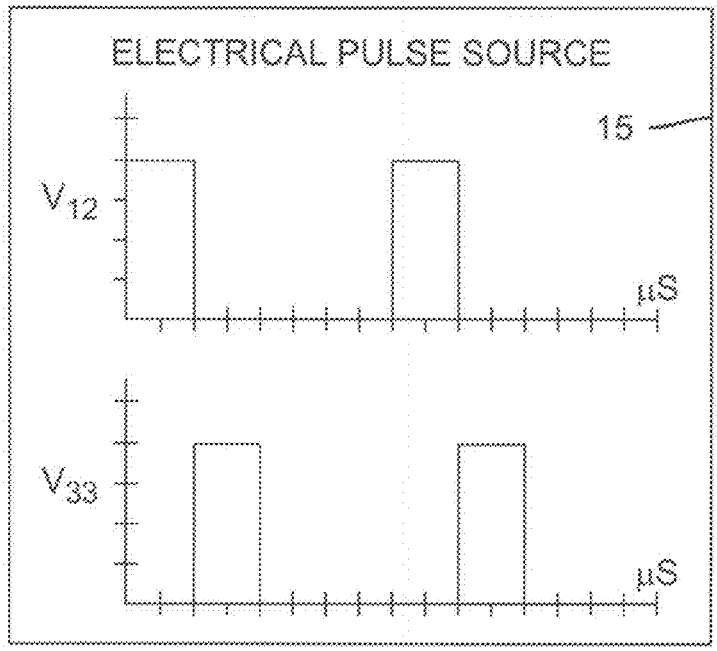
FIG. 3B is a control diagram showing graphs of the waveforms applied to different components of the thermal modulator in FIG. 3A.

FIG. 3B provides voltage waveforms that dictate how to control the thermal modulator shown in FIG. 3A. Similar to the diagram detailing the activation of the second example embodiment of the thermal modulator given in FIG. 2B, this set of waveforms shows a hot pulse followed by a cold pulse in one periodic cycle. The upper voltage waveform of FIG. 3B shows the positive voltage applied to the resistive heater 12. Furthermore, it is assumed that valve 33 will be electronically controlled. That is, when a positive potential is provided to the valve 33, by means of the electrical pulse source 15 and connector 16, it will open and let the cold fluid enter the fluid channel 30. When there is no electrical potential provided to valve 33, it will remain closed. In the thermal modulator described in the discussion of FIG. 3A, the heating function is carried out by keeping the valve 33 closed such that cooling fluid cannot pass through, and activating heater 12. Likewise, cooling occurs when no potential is provided to heater 12, and the valve 33 is open to let cooling fluid pass. Therefore the top and bottom waveforms of FIG. 3B share a common axis in time, such that a positive pulse is delivered to heater 12 while no pulse is delivered to valve 33 in order to heat the jet. When a cold pulse is applied, the top waveform is at zero potential, and the bottom one is at a positive value. The resulting heat flux through the thermal modulator and the temperature of the exiting jet will look the same as those in the graphs given in FIGS. 2C and 2D, respectively.

Figure 4A:
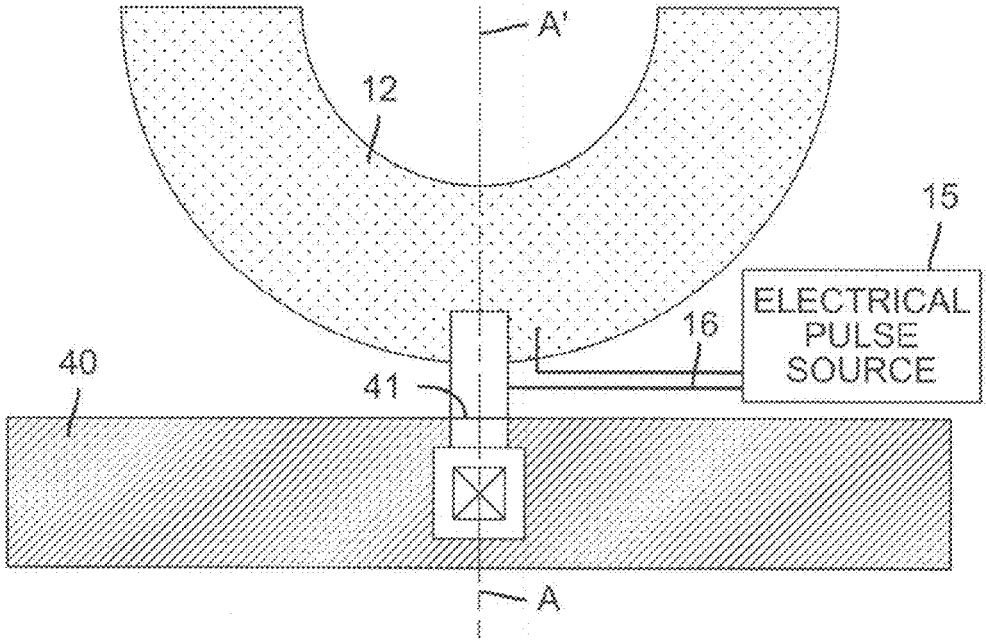
FIG. 4A is a top view of a thermal modulator from FIG. 1B that makes use of a mechanical cantilever to cool the fluid.
Figure 4B:
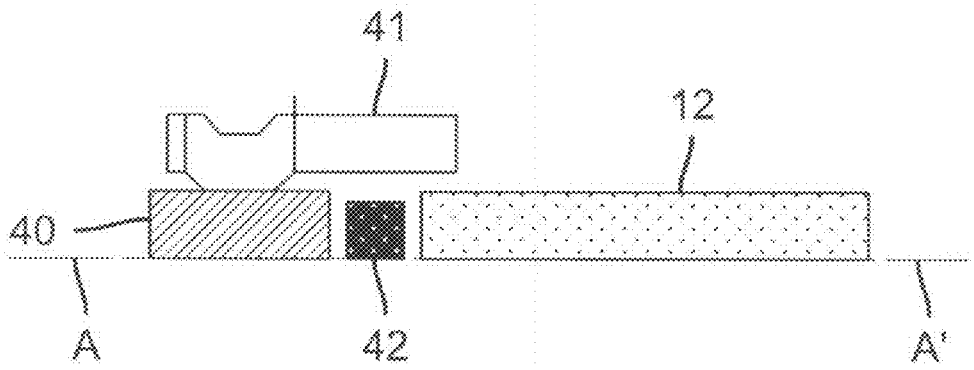
FIG. 4B is a side view of a thermal modulator from FIG. 1B that makes use of a mechanical cantilever to cool the fluid.
Figure 4C:
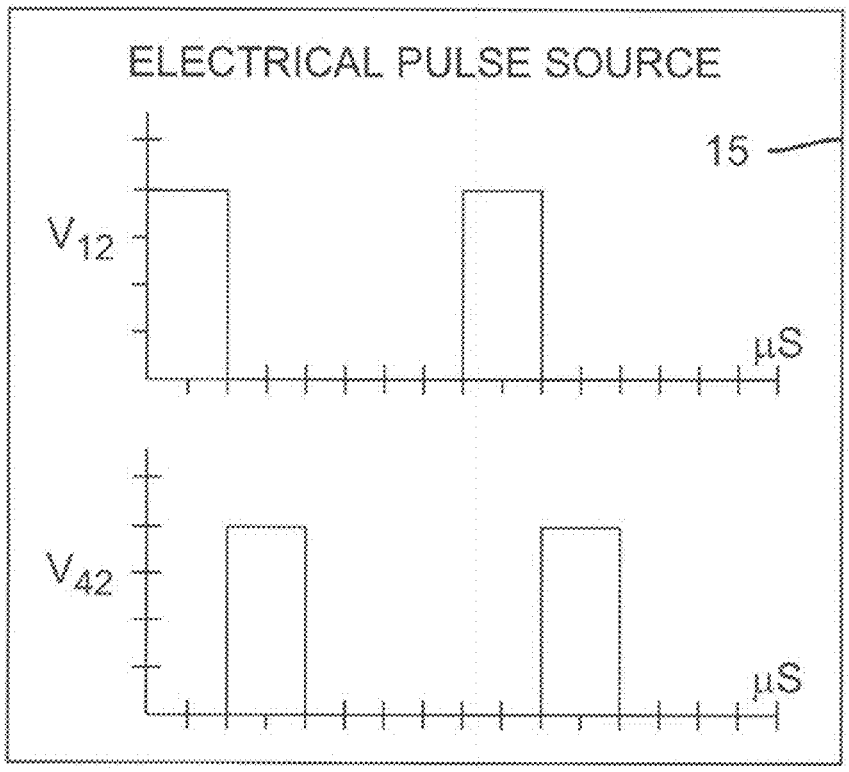
FIG. 4C is a control diagram showing graphs of the waveforms applied to different components of the thermal modulator in FIGS. 4A and 4B.

FIG. 4A and FIG. 4B show top and side views respectively, of yet another example embodiment of a thermal modulator that creates cold pulses through the use of a micro electromechanical cantilever. This thermal modulator also makes use of a resistive heater 12 that is made out of a thermally conductive material to surround the nozzle bore 11. Therefore, heat pulses are again controlled by electrical stimulation of the heater 12. However, cold pulses are created by keeping the heater off, and stimulating the deflection of the cantilever 41 tip until it touches the heater 12. The cantilever 41 is itself composed of a thermally conductive material such as, but not limited to, polysilicon or a metal. It is fabricated through standard MEMS surface micromachining techniques, well known to a person skilled in the art. The cantilever 41 sits on a source 40 that supplies the low temperature for the cooling to take place. This temperature must be significantly below the ambient temperature of the jetting fluid. The low temperature source 40 may maintain its state through various means, such as but not limited to a thermoelectric cooling device. Hence, it is the deflection of cantilever 41 that achieves the cold pulse application to the jetting fluid by selectively connecting heater 12 to the constant source of low temperature 40. The deflection of cantilever 41 itself may be controlled through electrostatics. When an electrical potential is applied to electrode 42, an electric field may be established in the space between cantilever 41 and electrode 42, as shown in FIG. 4B. Therefore, cold pulses may be controlled by electrical control of the electrode 42. Alternately, the cantilever itself may be created out of piezoelectric materials, such as but not limited to lead zirconate titanate (PZT). In this case, the PZT could be structured to form a piezoelectric bimorph in the shape of cantilever 41. In this case, electrode 42 will not be required, and will be replaced by electrode contacts to the piezoelectric cantilever, such that deflection may be controlled through the application of an electric potential. The voltage waveforms that dictate how to control this thermal modulator are shown in FIG. 4C. Similar to the waveforms given in FIG. 3B, the upper graph represents the voltage delivered to heater 12, while the lower graph represents the voltage delivered to electrode 42. Waveforms exiting the electrical pulse source 15 in this manner will activate heater 12 and the micro electromechanical cantilever beam 41 appropriately, to generate the heat pulse followed by a cold pulse. The heat flux through the thermal modulator and the temperature of the exiting jet will once again look the same as the graphs given in FIGS. 2C and 2D, respectively. A piezo cantilever preferably is made using at least one thick metallic electrode to increase its thermal conductivity.

Figure 5:
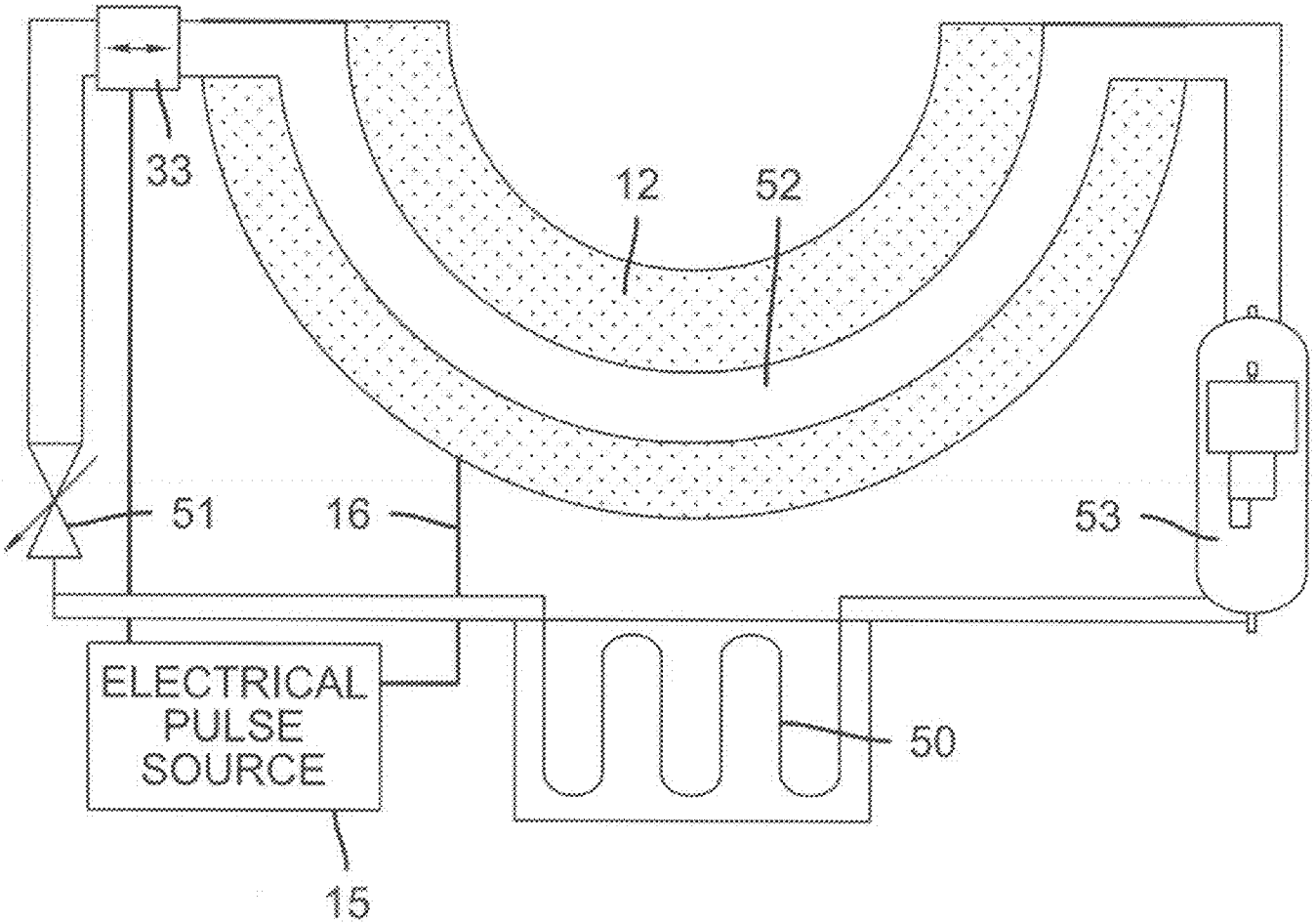
FIG. 5 is a top view of the a thermal modulator from FIG. 1B that uses a gas compression heat pump.

FIG. 5 shows a thermal modulator in which a gas compression pump, such as one used in a refrigeration system, is employed. This thermal modulator is similar to the one that cools with the use of an endothermic chemical reaction in that there is a resistive heater 12, which has a channel running through it. Therefore, heating is accomplished by the traditional means—applying electric potential to the heaters. In this thermal modulator however, the cooling channel forms part of the evaporating coil 52, for the hot gas used in the refrigeration cycle. FREON or another commonly used refrigerant may be used as the gas fed through the system. The hot vapor that comes out of the evaporating coil is then sent through the compressor 53, and forced into the condensing coil 50, where the refrigerant condenses back to liquid once more and releases its heat. Finally, the expansion valve 51 allows the refrigerant to enter the evaporating coil 52 once more to repeat the process. Before the refrigerant can be sent through the center of the heater however, the valve 33 must be released. Hence valve 33 is the control mechanism to selectively apply the cold pulse to the jet of fluid exiting nozzle bore 11. The voltage waveforms corresponding to the operation of this thermal modulator are exactly identical to those given in FIG. 3B. That is, this thermal modulator is controlled by resistive heater 12 and a channel 52 for cooling elements (in this case, refrigerant) just as the second embodiment was. The application of positive potential to the heater 12 and the valve 33 is therefore timed and carried out in the same way. Furthermore, the heat flux through the thermal modulator, and the temperature of the fluid jet exiting nozzle bore 11 is the same as those shown in the graphs of FIG. 2C and FIG. 2D, respectively.

Figure 6A:
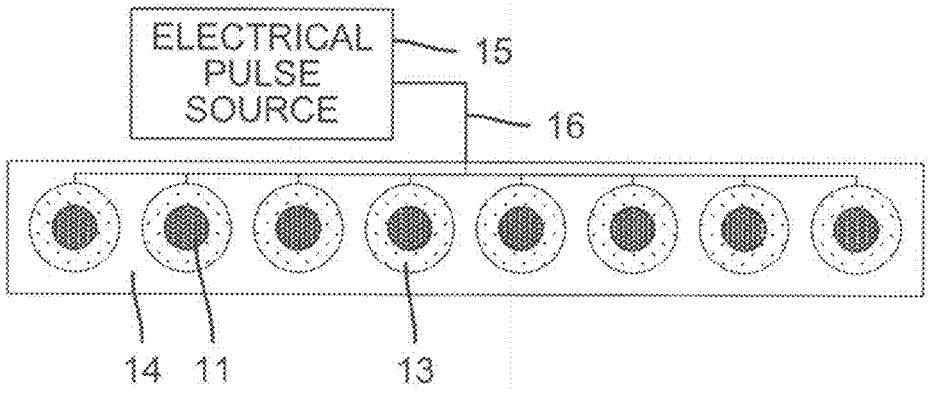
FIG. 6A is a schematic top view of the present invention in accordance with an example embodiment described in the waveforms of FIG. 6B-6F.
Figure 6B:
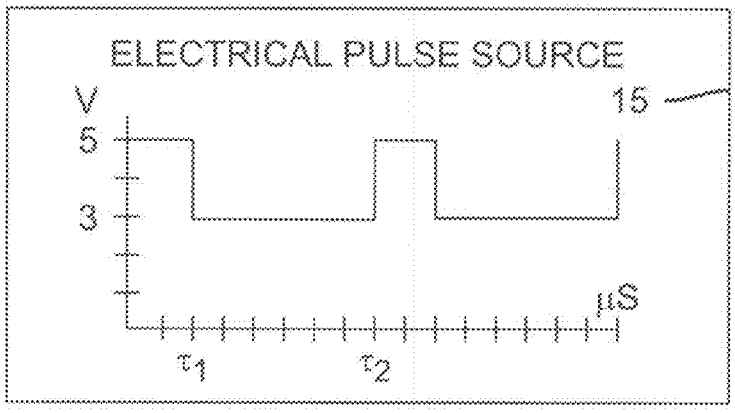
FIG. 6B is a graph of a waveform with positive going heat pulses imposed on a DC bias.
Figure 6C:
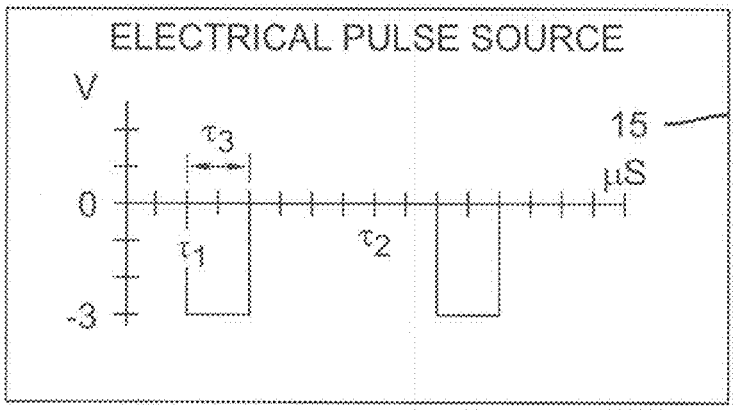
FIG. 6C is a graph of a negative going waveform shape.

FIG. 6A shows a thermal modulator printhead 14 and electrical pulse source 15, which constitutes yet another example embodiment of the present invention. Electrical pulse source 15 is connected through electrical pulse connector 16 to current print head 14, of a type capable of providing heat pulses to the jet, for example the device in accordance with the second example embodiment. Thermal modulator printhead 14 may be any type of print head described in the example embodiments, including print head 10, so long as the print head is capable of providing a heat pulse to the jet in response to source 15. Electrical pulse source 15, as shown in the waveform FIG. 6B, provides a constant DC bias with heat pulses superimposed on it. The DC bias is provided in order that the surface temperature of the fluid exiting nozzle bore 11 is greater that the ambient fluid temperature in the absence of the DC bias or of other pulses. Thereby the DC bias provides a heat biased jet whose temperature is greater than ambient, for example, by about 2 degrees. Celsius as measured at the jet surface. The surface temperature of the jet is generally greater than the temperature of the center of the jet, due to the DC bias. In accordance with the present invention, pulse source 15 in addition to providing a DC bias, can also provide additive pulses of a positive going type shown in FIG. 6D and additive pulses of a negative going type, FIG. 6C. Combining the pulses shown in FIGS. 6B and 6C creates the waveform shown in FIG. 6F. Therefore, source 15 is able to selectively raise and lower the surface temperature of the biased jet through the combination of the waveforms in FIG. 6B and FIG. 6C. Referring to FIGS. 6B, 6C, and 6F, the electrical pulse source 15, shown in FIG. 6A, is operable to provide a series of pulses to the thermal modulator 13, shown in FIG. 6A, that control the transient temperature lowering of the liquid. The series of pulses include a first pulse applied at a first power level for transferring heat to the liquid, a second pulse applied at a second power level for transferring heat to the liquid, and a third pulse applied at a third power level for transferring heat to the liquid. The third power level is in between the first power level and the second power level. This is also shown, as in the previous embodiments, by the flux profile in FIG. 2C, and temperature profile as shown in FIG. 2D, having the effect of reduction of the coalescence length shown in FIG. 7.

Figure 6D:
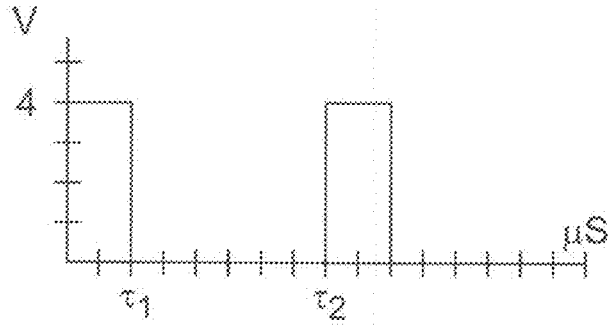
FIG. 6D is a graph of a positive going waveform shape.
Figure 6E:
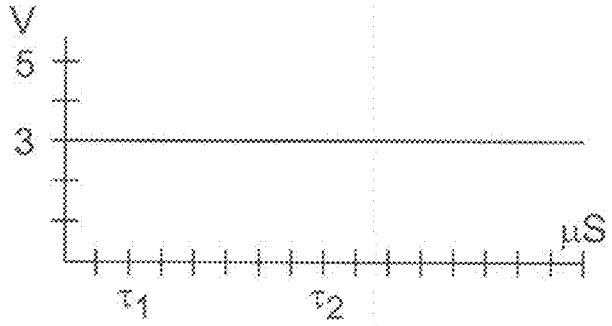
FIG. 6E is a graph of a waveform with constant DC bias.
Figure 6F:
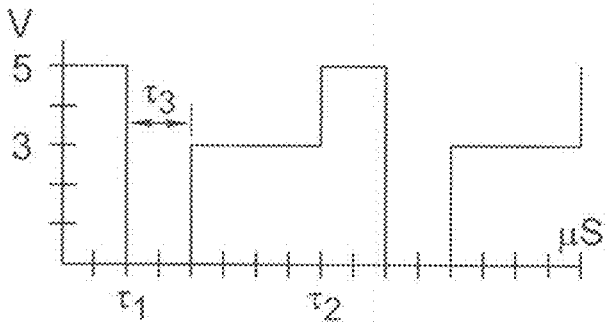
FIG. 6F is a graph of a waveform combining FIGS. 6B and 6C.

Considering the graphs provided in FIG. 6 in greater detail, FIG. 6D shows a typical waveform that is applied to the resistive heater 12. It is only used to create heat pulses. The resting level (or DC bias) of the heater is specified at 0 Volts on the waveform. A heat pulse with a magnitude of 4 Volts is applied for duration of $\tau_1$ microseconds every $\tau_2$ microseconds (the period). It has been noted through experiment however, that the waveform of FIG. 6B applied to heater 12 has the same effect as the waveform of FIG. 6D. In FIG. 6B the DC bias level has been raised to 3 Volts, as shown in FIG. 6E. Likewise, the heat pulse magnitudes have been raised to 5

Volts. All other aspects of FIG. 6B, i.e. the time at which the heat pulses are applied relative to the DC bias, are preserved from FIG. 6D. The waveform depicted in FIG. 6B has the same effect as the waveform depicted in FIG. 6D because the instantaneous change in the power delivered to the heater from the heat pulse has been kept the same. In other words, the 5 Volt heat pulse delivers the same amount of energy relative to the 3 Volt DC bias level, as the 4 Volt heat pulse delivers relative to the 0 Volt DC bias level. Therefore, adding the waveform shown in FIG. 6C with that of FIG. 6B, will produce a cold pulse waveform provided in FIG. 6F. In the cold pulse waveform of FIG. 6F, the cold pulse (application of 0 Volts to the heater 12) of duration $\tau_3$ microseconds is applied immediately following the hot pulse. We have discovered that such cold pulses have the same effects of reducing surface profile instabilities and reducing coalescence lengths as the cold pulses previously described. Therefore, applying the waveform shown in FIG. 6F to heater 12 or thermal modulator 13 via the electrical pulse generator 15 reduces coalescence lengths as shown in FIG. 2E.

As shown in FIGS. 6B, 6C, and 6F, at least one of the second pulse and the third pulse is applied to the column of liquid in between consecutive applications of the first pulse. The second pulse can immediately follows the first pulse. The third pulse can immediately precedes the first pulse. The first pulse has a first pulse width while the second pulse has a second pulse width. The first pulse width can be equal to the second pulse width. The second pulse effectively serves to remove heat from the column of liquid facilitating the drop break off process. The third pulse has an amplitude and a duration. The amplitude of the third pulse remains constant throughout the duration of the third pulse.

Figure 7:
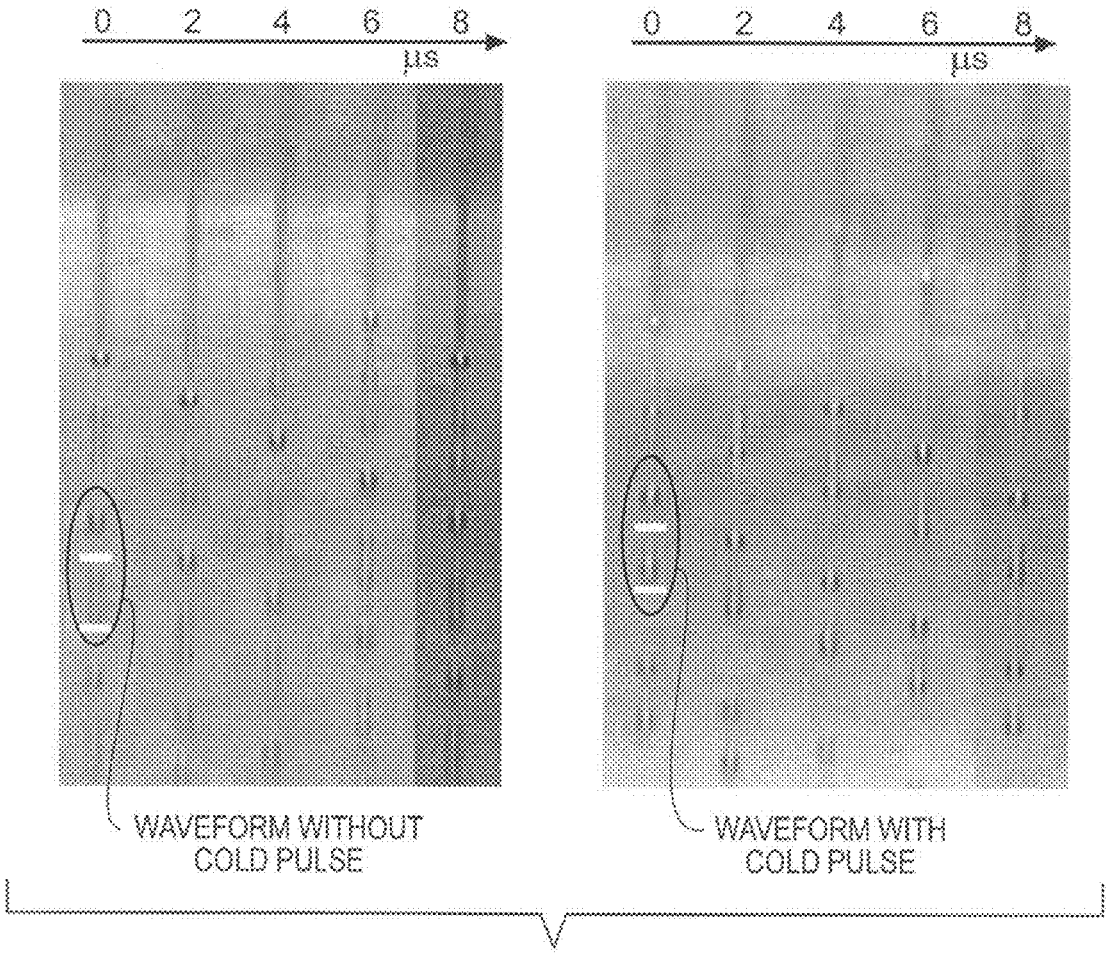
FIG. 7 is comparison of actual photos taken of the drop formation with and without the use of temperature lowering pulses.

FIG. 7 shows two actual time elapsed pictures of a jet exiting the print head 10 of FIG. 1A, implemented with the embodiment as described in the discussion of FIG. 6. The picture on the left uses a traditional heat pulse waveform as represented the positive going waveform shown in FIG. 6A, and the picture on the right includes cold pulses as shown by the waveform of FIG. 6E. Both pictures show the same jet that has been time elapsed every 2 microseconds as the drops move down the stream. The pictures have been included to demonstrate the improvement in coalescence length reduction by implementing cold pulses.

Although the term printhead is used herein, it is recognized that printheads are being used today to eject other types of fluids and not just ink. For example, the ejection of various liquids including medicines, pigments, dyes, conductive and semi-conductive organics, metal particles, and other materials is possible today using a printhead. As such, the term printhead is not intended to be limited to just devices that eject ink.

The invention has been described in detail with particular reference to certain example embodiments thereof, but it will be understood that variations and modifications can be effected within the scope of the invention.

PARTS LIST

10 Print head
11 Nozzle bore
12 Resistive heater
13 Thermal modulator
14 Thermal modulator print head
15 Electrical pulse source
16 Electrical pulse connector
20 Thermal conductor
21 Copper trace (electric path)
22*a* Contact electrode 1
22*b* Contact electrode 2
23 N-doped pellet
24 P-doped pellet
25 Heat sink
26 DC power supply
27 Polarity determining switches
30 Cold fluid channel
31 Chemical 1 inlet
32 Chemical 2 inlet
33 Valve
34 Cold fluid outlet
40 Source of low temperature supply
41 Conducting micro electromechanical cantilever beam
42 Electrode
50 Condensing coil
51 Expansion valve
52 Evaporating coil
53 Compressor
55 Liquid source

The invention claimed is:

1. A printer comprising:

a printhead including a nozzle bore;

a source of liquid, the liquid being under pressure sufficient to eject a column of the liquid through the nozzle bore, the liquid having a temperature;

a thermal modulator associated with the nozzle bore, the thermal modulator being operable to transiently modulate the temperature of the liquid as the liquid is ejected through the nozzle bore to cause drops to break off from the column of liquid ejected from the nozzle; and an electrical pulse source in electrical communication with the thermal modulator, the electrical pulse source being operable to provide a series of pulses to the thermal modulator that control the transient temperature lowering of the liquid, the series of pulses including a first pulse applied at a first power level for transferring heat to the liquid, a second pulse applied at a second power level for transferring heat to the liquid, and a third pulse applied at a third power level for transferring heat to the liquid, the third power level being in between the first power level and the second power level.

2. The printer of claim 1, wherein application of the first pulse causes a drop to break off from the column of liquid.

3. The printer of claim 1, wherein at least one of the second pulse and the third pulse is applied to the column of liquid in between consecutive applications of the first pulse.

4. The printer of claim 1, wherein the second pulse immediately follows the first pulse.

5. The printer of claim 1, wherein third pulse immediately precedes the first pulse.

6. The printer of claim 1, the first pulse having a first pulse width, the second pulse having a second pulse width, wherein the first pulse width is equal to the second pulse width.

7. The printer of claim 1, wherein the second pulse removes heat from the column of liquid.

8. The printer of claim 1, the third pulse having an amplitude, the third pulse having a duration, wherein the amplitude of the third pulse remains constant throughout the duration of the third pulse.

9. A method of forming drops comprising:

providing a printhead including a nozzle bore;

providing a source of liquid under pressure sufficient to eject a column of the liquid through the nozzle bore, the liquid having a temperature;

providing a thermal modulator associated with the nozzle bore, the thermal modulator being operable to transiently modulate the temperature of the liquid as the liquid is ejected through the nozzle bore to cause drops to break off from the column of liquid ejected from the nozzle;

providing an electrical pulse source in electrical communication with the thermal modulator; and causing a series of pulses to be provided to the thermal modulator that control the transient temperature lowering of the liquid using the electrical pulse source, the series of pulses including a first pulse applied at a first power level for transferring heat to the liquid, a second pulse applied at a second power level for transferring heat to the liquid, and a third pulse applied at a third power level for transferring heat to the liquid, the third power level being in between the first power level and the second power level.

* * * * *